US012523048B2

(12) United States Patent
Verrando

(10) Patent No.: US 12,523,048 B2
(45) Date of Patent: Jan. 13, 2026

(54) SELF-CLEANING DEVICE FOR APPLYING MATERIAL BETWEEN TILES ON VERTICAL SURFACES

(71) Applicant: Mirco Verrando, Ventimiglia (IT)

(72) Inventor: Mirco Verrando, Ventimiglia (IT)

( * ) Notice: Subject to any disclaimer, the term of this patent is extended or adjusted under 35 U.S.C. 154(b) by 72 days.

(21) Appl. No.: 18/711,770

(22) PCT Filed: Nov. 16, 2022

(86) PCT No.: PCT/EP2022/082149
§ 371 (c)(1),
(2) Date: May 20, 2024

(87) PCT Pub. No.: WO2023/094241
PCT Pub. Date: Jun. 1, 2023

(65) Prior Publication Data

US 2025/0034887 A1 Jan. 30, 2025

(30) Foreign Application Priority Data

Nov. 23, 2021 (IT) ..... 102021000029561

(51) Int. Cl.
*E04F 21/165* (2006.01)

(52) U.S. Cl.
CPC ..... *E04F 21/165* (2013.01)

(58) Field of Classification Search
None
See application file for complete search history.

(56) References Cited

U.S. PATENT DOCUMENTS 5,957,606 A 9/1999 Jafarmadar

FOREIGN PATENT DOCUMENTS

CN 112975979 A 6/2021

OTHER PUBLICATIONS

International Search Report and Written Opinion of the ISA for PCT/EP2022/082149, mailed Mar. 20, 2023, 11 pages.

*Primary Examiner* — Barbara J Musser
(74) *Attorney, Agent, or Firm* — NIXON & VANDERHYE

(57) ABSTRACT

Self-cleaning device for applying material between the grout lines of tiles on vertical surfaces (100) adapted to spread and model material of acrylic, silicone and/or soft cementitious paste type in order to create grout lines, joints or mortar on vertical surfaces preventing the product from sliding downwards; said self-cleaning device for applying material between the grout lines of tiles on vertical surfaces (100) adapted to speed up the laying operations and to reduce the effort applied by the operator to a minimum. It comprises at least one microfiber roller (17) adapted to be mobilized by at least one of the drive wheels (11) by means of a rubber belt (21) passing through a pulley (20), so as to clean the spatula (14) and the surface of said product (200) dispensed in excess. By means of a microcontroller (33) all the parameters of the orientable dispenser (17) and of the nebulizer of the liquid (18) are adjusted.

11 Claims, 2 Drawing Sheets

SELF-CLEANING DEVICE FOR APPLYING MATERIAL BETWEEN TILES ON VERTICAL SURFACES

This application is the U.S. national phase of International Application No. PCT/EP2022/082149 filed Nov. 16, 2022, which designated the U.S. and claims priority to IT patent application No. 102021000029561 filed Nov. 23, 2021, the entire contents of each of which are hereby incorporated by reference.

FIELD OF THE INVENTION

The present invention relates to the field of the production of devices which apply plaster material between the tiles and which remove the excess plaster left on the surface of the tiles after application. Even more specifically, an electromechanical device is disclosed for spreading material such as acrylic, silicone and/or mortar between the grout lines of tiles on vertical surfaces at a speed greater than that which can be obtained with the manual methods used in the art.

PRIOR ART

Liquid mortar is a finely worked and very thin mortar, and is used to fill cracks or grout lines such as those that form between tiles on a floor, shower wall or similar situations.

The mortar is generally applied by spreading it over the entire surface of the tile, compacting it in the grout lines and then removing excess mortar from the tile surfaces before it dries.

The plaster can only be applied to small areas at a time due to the need to clean the plaster from the tile surfaces before it hardens, which is a significant time-consuming factor.

The inherent drawbacks of applying mortar to tile surfaces are, precisely, the time requirements to complete large jobs and the labor intensity of bending over or working on one's knees.

To remedy these problems, various solutions have been proposed in recent years.

An example is provided by patent application U.S. Pat. No. 6,260,743B1 to GINO A. MAZZENGA. The patent claims a device for dispensing mortar in joints formed between laterally adjacent floor tiles. It comprises a hopper for containing an amount of mortar mounted on a movable frame.

The device comprises a plurality of nozzle sets coupled to the hopper through tubular channels. The nozzle sets are slidably coupled to a mounting bracket which extends parallel to the front of the frame assembly such that the lateral distance between the nozzle sets is adjustable to match the lateral distance between the joints formed by the floor tiles of various sizes. A pinion and a rack are attached to the mounting bracket so that the vertical distance between the nozzle assemblies and the floor tiles is also adjustable.

Another example is that of patent application U.S. Pat. No. 7,614,813B1 to CHANDRAKANT R. YANDE. The patent claims a mortar dispenser that dispenses a plaster mixture, stored in a container, through a tracing nipple in the shape of a square tooth, in turn provided with an on-off valve: it extrudes the mixture into the spaces between the previously laid tiles. Also included in the invention are a utility stand, a float device for mortar and a tracking wheel for maintaining a straight line. As the device is used, the material slides over the edges of the installed tiles over a predetermined width, gaps or tracks.

Despite these technical advances and the resolution of some problems, these devices are very bulky, subject to laborious maintenance, due to the many internal components that are difficult to reach, and above all they do not fully exploit the technologies available on the market today; moreover, due to their conformation they are not suitable for use on vertical surfaces.

The filling of the joints on vertical surfaces increases the problems exponentially, since the plaster, once laid, continues to slide downwards if it is not treated immediately.

The object of the present invention is to propose a device which not only provides for exponentially speeding up the operations of spreading the mortar between the tiles, but in the same way to benefit the operator by offering him/her an intuitive and comfortable tool to use on vertical surfaces. Many of the components are replaceable and easily accessible/removable, and due to the presence of state-of-the-art sensors, the precision of the tool allows very high results to be achieved.

DESCRIPTION OF THE INVENTION

According to the present invention, an innovative electromechanical device is provided for spreading and shaping in a practical and precise manner material of acrylic, silicone and/or soft cementitious paste type in order to create grout lines, joints or mortar on vertical surfaces, preventing the product from dripping downwards.

The device advantageously speeds up all the laying operations compared to what can be obtained with the manual methods used in the art, including cleaning the excess product dispensed, minimizing the effort made by the operator and safeguarding him/her from any occupational pathologies.

The device is composed of a rectangular frame, advantageously light, in which at least two drive wheels are engaged in parallel, which allows the invention to move along a surface. By virtue of a threaded spring regulator, engaged on the surface of the frame and connected to the drive wheel, it is possible to adjust the height thereof with respect to the surface, adapting to the customer's needs and adapting to any type of surface.

The motion of the drive wheels is supported by ergonomic handles installed along the lateral surfaces of the invention.

The drive wheels can advantageously provide a shock-absorbing system, which allows the operations to be made precise even on uneven surfaces.

Preferably, the stability of the device is further ensured by guides with wheels, engaged at the ends of the lower surface of said frame and placed in contact with the surface.

The laying and processing operations between the grout lines of the tiles are guaranteed by a nozzle package consisting of:

- an orientable dispenser;
- a nebulizer of the liquid;
- a spatula;
- a hydrated microfiber roller; and
- a secondary spatula for cleaning the roller.

All the electrical components of the nozzle package, and of the invention in general, are advantageously regulated by an internal microcontroller, connected to them by means of wiring. All adjustments are accessible by the user via a keypad installed on the surface of the frame. The electricity for all the components, including the motion of the drive wheels, is guaranteed by a rechargeable battery, installed inside the frame.

Specifically, the orientable dispenser, installed, facing downwards, in the central front part of the lower surface of the frame, is connected to a tank, installed in the immediate vicinity, which by virtue of an electric motor and a piston compresses the product, so that it emerges from its cartridge, previously loaded on the device, as said product is dispensed from the orientable dispenser. In one of the preferred embodiments, the invention provides a laser pointer, engaged on said orientable dispenser, which allows the user to receive clear information regarding the exact orientation of the orientable dispenser during use; moreover, the present device can advantageously provide a rotation sensor, installed near the drive wheel, which collects data regarding the speed assumed by the drive wheel and sends these to the microcontroller, making the delivery flow constant with respect to the speed of the drive wheel itself.

The nebulizer of the liquid, engaged behind said orientable dispenser, nebulizes, through an electric pump, the previously dispensed product, in such a way as to make its spreading and following cleaning thereof effective: the nebulizer of the liquid is also connected to a secondary tank, engaged in the immediate vicinity, which contains the liquids to be nebulized.

By virtue of a spatula, engaged in the lower surface of the frame and behind the nebulizer of the liquid, the device advantageously spreads the previously dispensed product inside the grout lines of the tiles as it is moved forward. The spatula is preferably of the replaceable type and adjustable according to the customer's needs, in such a way as to adapt and work perfectly on all surfaces.

The microfiber roller, also engaged in the lower part of the frame but above all in close contact with the rear part of said spatula, is made to rotate by at least one of the drive wheels by means of a rubber belt; the rubber belt, being connected to the drive wheel and passing through a pulley, the latter used in the upper part of the microfiber roller, allows the rotation of the roller: in this way, it not only constantly cleans said spatula, but also allows the device to clean the surface of the excess product dispensed, coming out of the grout lines and dripping downwards. Furthermore, the rubber belt advantageously works, by means of a guide system, in a crossed manner, allowing the microfiber roller provided with a pulley to rotate at a speed greater than that assumed by the drive wheel.

The cleaning of the microfiber roller is guaranteed on the one hand by a secondary nebulizer, engaged inside the frame and connected to the secondary tank, which makes it constantly hydrated, and on the other hand by a secondary spatula, engaged on the rear and/or front in close contact with it, which exploiting the direct contact and rotation assumed by the roller removes the product attached thereto. This secondary spatula may be provided with a suction system that not only allows the product to be removed with greater precision on said microfiber roller, but, being connected to said tank, it allows the suctioned product to be filtered and recovered, so that it is reusable thus avoiding waste.

In one of the preferred embodiments thereof, the present invention may comprise an air bubble level, engaged on the upper surface of the frame, suitable to allow the horizontality and the verticality assumed by the device during its use to be controlled.

Finally, the device can advantageously comprise a micro-video camera, engaged in the lower part of the frame, adapted to capture the images during use: said micro-video camera can be connected, via network and/or Bluetooth, to any mobile device; in this way, the user can have access to all the captured images and view, in real time, the correct functioning of the device. The advantages offered by the present invention are clear in the light of the above description and will be even clearer from the accompanying figures and the related detailed description.

DESCRIPTION OF THE FIGURES

The invention will hereinafter be described in at least a preferred embodiment thereof by way of non-limiting example with the aid of the accompanying figures, in which.

DETAILED DESCRIPTION OF THE INVENTION

The present invention will now be described purely by way of non-limiting or binding example with the aid of the figures, which illustrate some embodiments relative to the present inventive concept.

Figure 1:
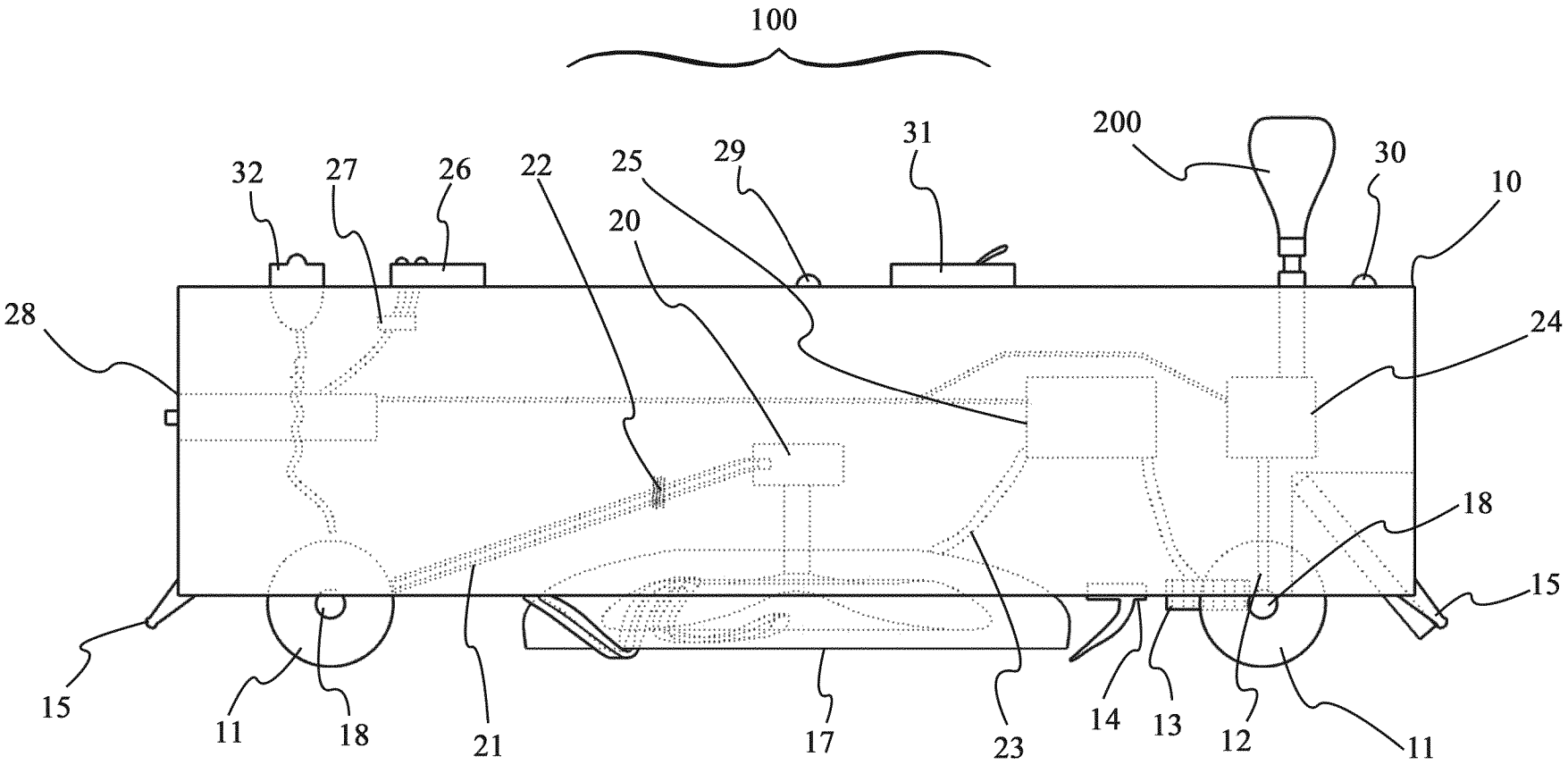
FIG. 1 shows a side view of a vertical section of a self-cleaning device for applying material between the grout lines of tiles on vertical surfaces 100 according to the present patent application.
Figure 2:
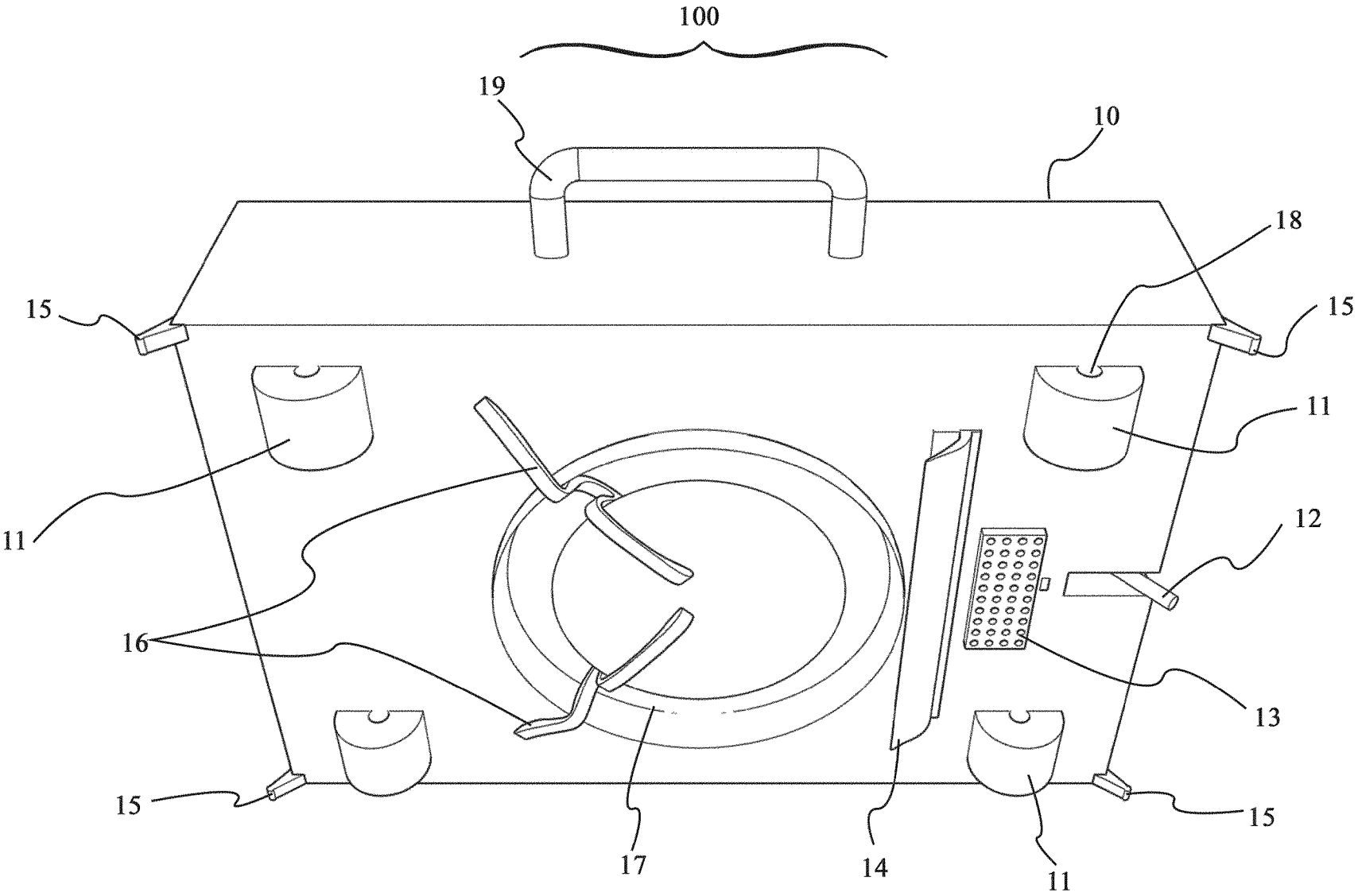
FIG. 2 shows a bottom view of the components of a self-cleaning device for applying material between the grout lines of tiles on vertical surfaces 100 according to the present patent application.

With reference to FIGS. 1 and 2, the main components of a self-cleaning device for applying material between the grout lines of tiles on vertical surfaces 100 according to the present patent application are shown. In particular, FIG. 1 shows a side view of a vertical section of the self-cleaning device for applying material between the grout lines of tiles on vertical surfaces 100; FIG. 2 shows a bottom view of some components belonging to the self-cleaning device for applying material between the grout lines of tiles on vertical surfaces 100.

The invention consists of a frame 10, with rectangular form, adapted to contain, maintain quite stable/firm and protect the internal components of the invention;

Inside said frame 10, precisely near the two long sides of the lower surface, two pairs of parallel drive wheels 11 are engaged, adapted to be moved by the user by means of handles 19, engaged along the lateral surfaces of the frame 10, allowing the movement of the invention along a surface. By virtue of a threaded spring regulator 32, engaged on the surface and connected to said drive wheels 11, it is possible to adjust the height thereof with respect to the surface. The distance of said drive wheels 11 is adjustable along an axis 18, engaged inside said frame 10 and passing through said drive wheels 11, by means of a locking system, in such a way as not to interfere with the spreading of the product 200.

To improve the stability of the invention, four guides with wheels 15 are engaged at the ends of the lower surface of said frame 10: by means of contact with the surface, they provide further precision during the use of the device 100.

The dispensing of the product 200 and its processing are performed by a series of components described below.

The dispensing of the product 200 to be inserted inside the space between the tiles is ensured by an orientable dispenser 12, by means of an electric motor.

Said orientable dispenser 12 is connected to a tank 24, installed in the immediate vicinity, adapted to contain said product 200 to be dispensed, and being provided with an electric motor and a piston, it compresses said product 200, so that it comes out of its cartridge, as said product is dispensed through said orientable dispenser 12.

A nebulizer of the liquid 13, engaged in the lower part of said frame 10 behind said orientable dispenser 12, nebulizes, by means of an electric pump, the previously dispensed product 200, in such a way as to make its application and subsequent cleaning effective.

The nebulizer of the liquid 13 is also connected to a secondary tank 25, engaged in the immediate vicinity and within the frame 10, adapted to contain the liquids to be nebulized.

Said tank 24 and said secondary tank 25 each comprise a capacity sensor adapted to activate LEDs 30-29, engaged on the surface of the frame 10, when the product 200 and/or the liquids have terminated. By means of a door 31, engaged in the upper part of said frame 10, both tanks 24-25 can be removed, in such a way as to allow constant cleaning and maintenance thereof.

The invention provides a spatula 14, engaged in the lower surface of said frame 10 and behind the nebulizer of the liquid 13, which performs the function of spreading the previously dispensed product 200 inside the grout lines of the tiles. The spatula 14 is replaceable and adjustable according to the customer's needs.

A microfiber roller 17 with pulley 20 is engaged in close contact with the rear part of said spatula 14 and is adapted to be moved by one of the drive wheels 11 by means of a rubber belt 21 passing through said pulley 20, in such a way as to constantly clean and at the same time both said spatula 14 and the surface from said product 200 dispensed in excess, outside the grout lines: said rubber belt 21 is engaged inside said frame 10, and works in a cross manner by means of a system of guides 22, in such a way that the microfiber roller 17 rotates at a speed greater than that assumed by the drive wheel 11.

The microfiber roller 17 is, in turn, constantly clean, by virtue of the hydration obtained from a secondary nebulizer 23, connected to said secondary tank 25, and by virtue of a secondary spatula 16, engaged at the rear and in close contact with said microfiber roller 17: the secondary spatula 16, exploiting the direct contact and rotation assumed by said microfiber roller pulley 20, removes the previously removed attached product 200.

A microcontroller 27, installed inside said frame 10, regulates all the electrical components of the invention by means of wiring, in such a way that said orientable dispenser 12, said nebulizer of the liquid 13, said spatula 14 and said microfiber roller 17 support the motion of said drive wheel 11. All the functions and adjustments provided by the microcontroller 27 are accessible by means of a keypad 26 connected to it, installed on the upper surface of said frame 10. The autonomy and electrical energy necessary for the operation of the electrical components and for the motion of said drive wheels 11 are ensured by a rechargeable battery 28, installed inside the frame 10.

Finally, it is clear that modifications, additions or variants may be made to the invention described thus far which are apparent to those skilled in the art, without departing from the scope of protection that is provided by the appended claims.

The invention claimed is:

1. Self-cleaning device configured to apply material between tiles on vertical surfaces adapted to spread and model material of acrylic, silicone and/or soft cementitious paste type in order to create grout lines, joints or mortar; said self-cleaning device adapted to speed up the operations for implementation and to reduce to a minimum the force exerted by the operator, protecting the operator from possible professional pathologies; said self-cleaning device comprising:

a frame, with rectangular form, adapted to contain, maintain quite stable/firm and protect internal components of the self-cleaning device;

at least two drive wheels, engaged parallel near opposite long sides of a lower surface of said frame, adapted to be moved by user handles, installed along lateral surfaces of said frame, allowing movement of the self-cleaning device along a surface; said drive wheels being height adjustable by means of a threaded spring regulator;

at least an orientable dispenser, engaged in a front and central part of the lower surface of said frame and pointed downward, adapted to dispense product contained in a cartridge to be inserted within the space between the tiles by means of a small electric motor; said orientable dispenser being connected to a product tank, installed in an immediate vicinity within said frame, adapted to contain said product to be dispensed; said product tank being provided with one said small electric motor and a piston adapted to compress said product, in a manner such that the product exits from the cartridge, as said product is progressively dispensed by means of said orientable dispenser;

at least a nebulizer of liquid, engaged in the lower surface of said frame behind said orientable dispenser, adapted to nebulize, by means of an electric pump, the dispensed product, in a manner such to render effective the spreading and the subsequent cleaning of said product; said nebulizer of the liquid being connected to a secondary tank, engaged in an immediate vicinity and within said frame, adapted to contain the liquid to be nebulized;

at least a spatula, engaged in the lower surface of said frame and behind said nebulizer of the liquid, adapted to spread, within the grout lines of the tiles, the previously dispensed product; said spatula being of replaceable and adjustable type;

at least a microfiber roller, engaged in the lower surface of said frame and in close contact with a rear part of said spatula, adapted to be moved by at least one of said drive wheels by means of a rubber belt passing through a pulley, in a manner such to clean said spatula and the surface of said product that is dispensed in excess; said pulley being engaged in an upper part of said microfiber roller, in a manner such that the rotation taken on by movement of said rubber belt is transmitted to said microfiber roller; said rubber belt, being engaged within said frame, and adapted to work in a cross manner by means of a system of guides, in a manner such that said microfiber roller rotates at a greater speed than that taken on by said drive wheel; said microfiber roller being constantly hydrated by means of a secondary nebulizer, engaged within said frame and connected to said secondary tank; said microfiber roller adapted to be maintained clean by means of at least a secondary spatula, engaged in the lower part surface of said frame, behind and/or in front and in close contact with said microfiber roller; said secondary spatula adapted to exploit the direct contact and the rotation taken on by said microfiber roller, in a manner such to remove the product attached thereto;

at least a microcontroller, installed within said frame, adapted to regulate all electrical components of the self-cleaning device by means of wiring, in a manner such that said orientable dispenser, said nebulizer of the liquid, said spatula and said microfiber roller follow the motion of said drive wheels; said microcontroller adapted to allow the user to access all functions by means of a keypad connected thereto, installed on an upper surface of said frame;

at least a rechargeable battery, engaged within said frame, adapted to power supply the motion of said drive wheels and all the electrical components of the self-cleaning device; and at least two guides with small wheels, engaged at ends of the lower surface of said frame, adapted to maintain the self-cleaning device stable during use by means of the contact with the surface.

2. The self-cleaning device for applying material between tiles on vertical surfaces, according to claim 1, wherein a distance of said drive wheels is adjustable along an axis, engaged within said frame and passing through said drive wheels, by means of a locking system, in a manner such to not interfere with the spreading of said product.

3. The self-cleaning device for applying material between tiles on vertical surfaces according to claim 1, wherein said drive wheels are provided with a shock absorption system.

4. The self-cleaning device for applying material between tiles on vertical surfaces according to claim 1, wherein said secondary spatula is provided with a suction system adapted to remove said product on said microfiber roller; said suction system, being connected to said product tank, adapted to filter and recover said suctioned product.

5. The self-cleaning device for applying material between tiles on vertical surfaces according to claim 1, wherein said product tank and said secondary tank are extractable by means of a door, engaged in the upper surface of said frame.

6. The self-cleaning device for applying material between tiles on vertical surfaces, according to claim 1, wherein said product tank comprises a capacity sensor adapted to activate a LED, engaged on the surface of said frame, when said product has been consumed.

7. The self-cleaning device for applying material between tiles on vertical surfaces, according to claim 1, wherein said secondary tank comprises a capacity sensor adapted to activate a LED, engaged on the surface of said frame, when the liquid present within said secondary tank has been consumed.

8. The self-cleaning device for applying material between tiles on vertical surfaces, according to claim 1, further comprising a spirit level, engaged on the upper surface of said frame, adapted to allow controlling a horizontal and/or vertical position taken on by the device during use.

9. The self-cleaning device for applying material between tiles on vertical surfaces, according to claim 1, further comprising at least a rotation sensor, installed near said drive wheels, adapted to collect data regarding the speed taken on by said drive wheels and to send such data to said micro-controller in a manner such that the dispensing flow of said orientable dispenser is constant with respect to the speed of said drive wheels.

10. The self-cleaning device for applying material between tiles on vertical surfaces, according to claim 1, further comprising a laser pointer, engaged on said orientable dispenser, adapted to allow the user to receive clear information regarding an exact orientation of said orientable dispenser during use.

11. The self-cleaning device for applying material between tiles on vertical surfaces, according to claim 1, further comprising a micro-video camera, engaged in the lower surface of said frame, adapted to capture images during use of the self-cleaning device; said micro-video camera being connected, by means of network and/or Bluetooth, to a mobile device of the user, in a manner such to allow said user to view the images of the operation and correct working of the self-cleaning device in real time on the user's own mobile device.

* * * * *